US006647974B1

(12) United States Patent
Cowan

(10) Patent No.: US 6,647,974 B1
(45) Date of Patent: Nov. 18, 2003

(54) IGNITER CIRCUIT WITH AN AIR GAP

(76) Inventor: Thomas L. Cowan, Building 337, Gabreski Airport, P.O. Box 763, Westhampton Beach, NY (US) 11978

( * ) Notice: Subject to any disclaimer, the term of this patent is extended or adjusted under 35 U.S.C. 154(b) by 0 days.

(21) Appl. No.: 10/246,111

(22) Filed: Sep. 18, 2002

(51) Int. Cl.[7] ..... F02P 3/06
(52) U.S. Cl. ..... 123/604; 123/622; 123/627
(58) Field of Search ..... 123/598, 604, 123/620, 627, 655, 656, 640, 606, 628, 622; 361/247, 253, 256, 257, 261

(56) References Cited

U.S. PATENT DOCUMENTS 4,287,862 A * 9/1981 Noguchi et al. ..... 123/310
4,301,782 A 11/1981 Wainwright
4,441,479 A * 4/1984 Endo et al. ..... 123/605
4,658,773 A * 4/1987 Treudler ..... 123/146.5 A
4,973,896 A * 11/1990 Shiga et al. ..... 322/28
5,170,768 A * 12/1992 Eileraas ..... 123/634
5,330,559 A * 7/1994 Cheney et al. ..... 95/63
5,471,362 A 11/1995 Gowan
5,474,599 A * 12/1995 Cheney et al. ..... 96/55
5,569,998 A 10/1996 Cowan
5,596,974 A 1/1997 Hall et al.
5,654,868 A * 8/1997 Buer ..... 361/256
5,793,585 A 8/1998 Cowan
6,052,270 A 4/2000 Kinge
6,138,653 A 10/2000 Juffinger
6,167,875 B1 1/2001 French et al.
6,536,406 B2 * 3/2003 Matsubara et al. ..... 123/310

* cited by examiner

*Primary Examiner*—John Kwon
(74) *Attorney, Agent, or Firm*—Scully, Scott, Murphy & Presser

(57) ABSTRACT

Ignition systems of the kind used to ignite a difficult-to-ignite fuel oil by using energy stored in a capacitor at a breakdown for creating an ignition arc at the electrodes of a spark plug, designed to preclude interference of contaminants with conduction of an ignition arc across an established current path between the electrodes of the spark plug. An air gap and a sparkplug are connected in series, wherein the sparkplug produces an ignition arc in a fuel to be ignited. A first high voltage power supply develops a first direct current voltage across the capacitor, which is supplied as a voltage across the air gap and the spark plug. A second high voltage power supply supplies a second pulsed voltage across the air gap and the spark plug, wherein the second pulsed voltage is substantially higher than the first direct current voltage, and the second pulsed voltage jumps the gap of the air gap and thus initiates an ignition arc, and the first direct current voltage is current limiting thereby allowing the capacitor voltage to approach zero, and thus allowing the air gap to cease conducting, thereby allowing the cycle to repeat itself. A diode is positioned between the second pulsed voltage and the capacitor of the first high voltage power supply to isolate the capacitor from the second pulsed voltage.

11 Claims, 2 Drawing Sheets

IGNITER CIRCUIT WITH AN AIR GAP

BACKGROUND OF THE INVENTION

1. Field of the Invention

The present invention relates generally to a capacitive discharge igniter circuit of the kind used to ignite a difficult-to-ignite fuel by using the energy stored in a capacitor which is discharged at a threshold breakdown voltage for creating an ignition arc at the electrodes of a spark plug.

A typical environment for the use of the present invention is for systems that are used to ignite extremely dirty fuels such as fuel oils. In such systems, the fuel and contaminants can tend to short the conductive path across the electrodes of simple sparking devices and plugs (such as generated by a 10,000 volt transformer), such that the ignition current shorts out through the dirty fuel and contaminants without generating a spark at the electrodes of the spark plug to light the fuel. This problem is normally addressed in the prior art by the use of a semiconductor material placed between the electrodes of the sparking device or by the creation of a current path of low voltage potential between the electrodes of the sparking device, whereby the space about the electrodes becomes ionized to lower resistance, thereby allowing a rapid discharge of energy stored in a capacitor between the electrodes so as to provide a hot arc for fuel ignition. It is the rapid discharge of energy, stored in a capacitor, at the electrodes of the spark plug that accounts for it's ability to burn through contaminants and thereby generate an arc that can ignite the fuel.

A capacitive discharge corona arc circuit of the type disclosed in U.S. Pat. Nos. 5,471,362 and 5,793,585 charges a capacitor which is then discharged through a corona arc circuit. This is an example of an arc being generated via a current path. These patents also mention and describe the prior art "resistive path" modality mentioned above.

The present invention is an evolution in that type of capacitive discharge corona arc igniter circuit, and provides a secondary power source for such power arc circuits that allows the creation of the ionized area about the electrodes of the sparking device in the event that a film of fuel has created a contaminant layer about the electrodes.

2. Discussion of the Prior Art

U.S. Pat. No. 5,471,362 discloses an arc circuit which has a spark plug connected in series with a spark gap device and a rectifier. A spark gap device is a relatively expensive component in which all oxygen is removed, often with getterers, and the device is then refilled with a specialty gas in such a manner that it establishes a characteristic of having a precise threshold breakdown voltage. It is this characteristic "break down voltage" that manages the circuit. The circuit is inoperable without it, and it would be beneficial to eliminate the expense of this component. A capacitor is connected in series with the spark gap and the spark plug. An electrical power source has a transformer with a primary winding providing an AC voltage and a secondary winding connected to the capacitor via a rectifier for charging the capacitor. The secondary winding is connected to the spark plug via a diode, thereby providing a current path for the spark gap at a predetermined voltage and simultaneously discharging the capacitor through the spark plug via the spark gap.

U.S. Pat. No. 5,793,585 discloses a similar power arc circuit having a high voltage power source connected to the power arc circuit downstream of a high voltage, high current diode, and by a relay connected between a power input and the power arc circuit, which has a series connection of a spark gap, a diode and a spark plug.

SUMMARY OF THE INVENTION

Accordingly, it is a primary object of the present invention to provide an igniter circuit with an air gap for ignition systems of the kind used to ignite a difficult-to-ignite fuel oil by using energy stored in a capacitor which is discharged to create an ignition arc at the electrodes of a spark plug.

A further object of the subject invention is the provision of a secondary power source for such power arc circuits that allows the creation of an ionized area about the electrodes of the sparking device to facilitate the discharge of a stored energy source into the arc at the spark plug.

The present invention advantageously uses a simple air gap, with an irrelevant breakdown voltage, rather than a commercially available spark gap device, to eliminate the need for and expense of a commercially available spark gap device, and the costs and availability problems associated with commercially available spark gap devices. The present invention also uses a relatively simple timing circuit comprised of commercially available components to trigger its prime components.

BRIEF DESCRIPTION OF THE DRAWINGS

The foregoing objects and advantages of the present invention for an igniter circuit with an air gap may be more readily understood by one skilled in the art with reference being had to the following detailed description of several embodiments thereof, taken in conjunction with the accompanying drawings wherein like elements are designated by identical reference numerals throughout the several views, and in which.

DETAILED DESCRIPTION OF THE INVENTION

Figure 1:
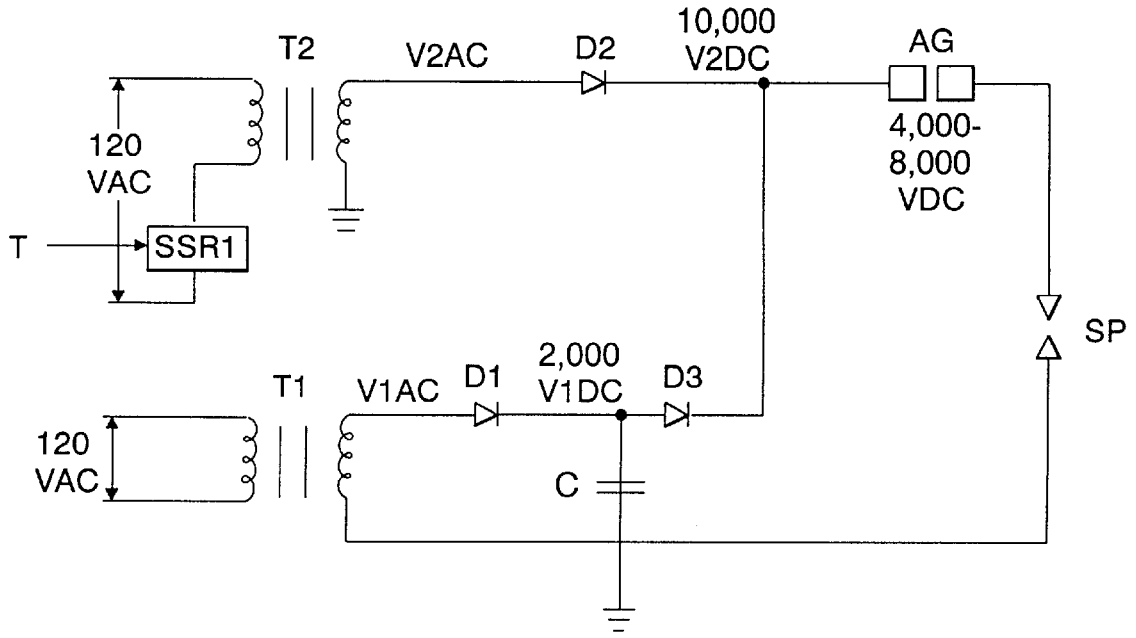
FIG. 1 illustrates a first embodiment of an igniter circuit pursuant to the present invention which uses an air gap rather than a spark gap, and which also operates with a commonly timed power supply.

FIG. 1 illustrates a first embodiment of an igniter circuit pursuant to the present invention which uses an air gap AG rather than a spark gap, as in the prior art, and which also operates with a commonly timed power supply. The arc gap AG can be sealed or exposed and has air at atmospheric pressure between opposed electrodes thereof, with a permitted crude and wide range of breakdown values.

In the igniter circuit of FIG. 1, a first transformer T1 is a commercially available component which receives a typical input of 120 VAC, and generates an output voltage V1AC of approximately 2,000 volts. The first transformer T1 is naturally current limiting, operates from a normal input power source, and is always on when the igniter circuit unit is energized. A diode D1 rectifies the 2000 V1AC to 2,000 V1DC which charges a capacitor C, and the voltage across capacitor C is available through a diode D3 as an input to the air gap AG.

A second transformer T2 is a commercially available component which also receives a typical input of 120 VAC, and generates an output voltage V2AC of approximately 5,000 to 10,000 or higher volts. However, the second transformer T2 is only activated on when a trigger signal T is present to a solid state relay SSR1 coupled in series with the input to transformer T2.

Diodes D1, D2 are high voltage diodes which convert their input AC voltages V1AC and V2AC from AC to DC. High current diode D3 is selected and designed to have sufficient high voltage capability to prevent output voltage V2DC from backcharging the capacitor C. The storage capacitor C is designed for rapid current discharging and rapid current recharging. Diodes D1, D2 and D3 could comprise more than one diode placed in parallel or series.

The solid state relay SSR1 is a commercially available component which is selected and designed to turn on a 100 watt circuit at a frequency between 1 and 20 HZ. Depending upon the particular circuit design, it is either an AC or DC type, and is initiated by a trigger signal T.

The air gap AG and the series coupled electrodes of the sparkplug SP present a threshold voltage such that the capacitor charges until the charge voltage thereacross reaches the threshold voltage, and then the capacitor discharges through the air gap AG and the ignition electrodes in a sparkplug SP connected in series therewith.

The Air gap AG could be sealed for safety or could be simply an air gap of about ⅛" opening between two opposed electrodes. The breakdown voltage can be variable between 4000 and 8000 volts by varying the width of the air gap and the surface areas of the electrode conductors on opposite side S the air gap.

The sparkplug is designed to deliver a high current, short impulse, surface arc to ignite fuel oils which are difficult to ignite, and its electrodes present a gap in the circuit similar to the air gap AG.

Figure 2:
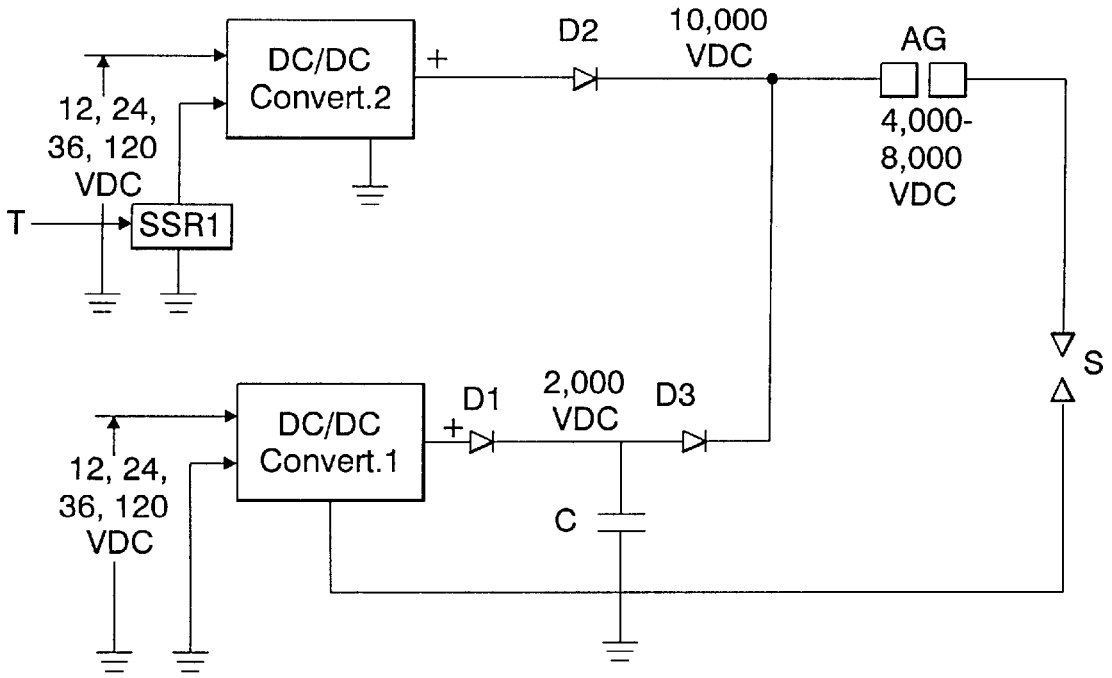
FIG. 2 illustrates a second embodiment of an igniter circuit pursuant to the present invention wherein the first and second transformers and diodes are replaced by first and second DC to DC converter circuits.

FIG. 2 illustrates a second embodiment of an igniter circuit pursuant to the present invention wherein the first transformer T1 and diode D1 of FIG. 1 are replaced by a DC to DC converter circuit, wherein an input of 12 or 24 or 36 or 120 VDC is converted to an output of 2,000 VDC, and the second transformer T2 and diode D2 of FIG. 1 are replaced by a DC to DC converter circuit, wherein an input of 12 or 24 or 36 or 120 VDC is converted to an output of approximately 10,000 VDC. Otherwise, the second embodiment of the igniter circuit operates in substantially the same manner as the first embodiment of the igniter.

The trigger signal T can operate in one of three or more modes:

1) When the voltage V1 across the capacitor C reaches a voltage of ~2,000 VDC, the trigger signal T which is a short duration pulse having a width on the order of 5 to 20 milliseconds is then turned on, and is then turned off until V1 again reaches ~2,000 VDC.

2) Operation mode 2) is similar to operation mode 1) except that the trigger signal T is turned off when the voltage V1 across the capacitor C drops to a low value such as 500 volts.

3) In a third operation mode of operation, the trigger signal T is pulsed on at a fixed rate for a finite duration, such as 4 pulses per second, with each pulse having a pulse width of approximately 20 milliseconds. In this case the capacitor's voltage could have a varied value.

In all of the operation modes, the trigger signal T for transformer T2 is turned on for a short period of time in an intermittent and repetitious manner to cause a spark at the air gap AG and the spark plug SP to cause a cyclical discharge of the capacitor C.

Figure 3:
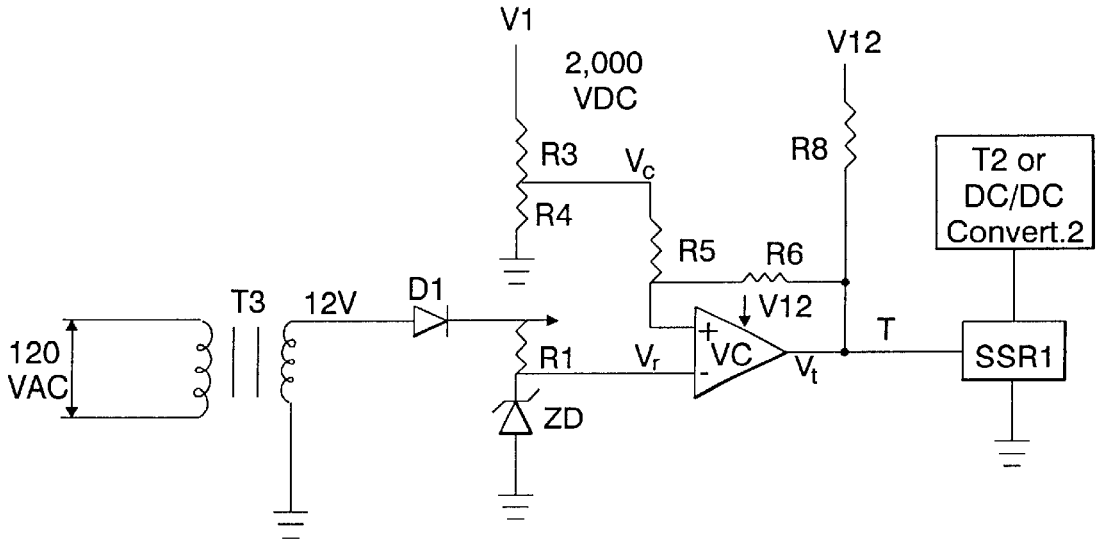
FIG. 3 illustrates an exemplary embodiment of a trigger circuit to develop an ignition trigger signal T.

FIG. 3 illustrates an exemplary embodiment of a trigger circuit to develop the trigger signal T. In FIG. 3, an input transformer T3 converts an input voltage 120 VAC to 12 VAC which is rectified by a diode D4 to a 12 VDC power supply, shown as V12. A first voltage divider circuit, comprised of a resistor R1 and a Zener diode ZD, having a threshold breakdown voltage, develops a reference voltage Vr of approximately 4 volts. A second voltage divider circuit comprised of resistors R3 and R4 provides a voltage Vc representive of the capacitor voltage V1. Vc=V1/500 or 2000/500=4 volts when V1=2,000 volts. Resistors R5 and R6 provide a hysteresis such that an integrated circuit voltage comparator VC generates an output Vt=12 volts when Vc=4 volts and V1=2,000 VDC. The 12 volt signal Vt energizes the Solid State Relay SSR1, which can be connected as in FIG. 1 or 2, to cause it to conduct, and Vt=0 when Vc drops to 1 volt (V1=500 VDC), terminating conduction through the SSR1.

Figure 4:
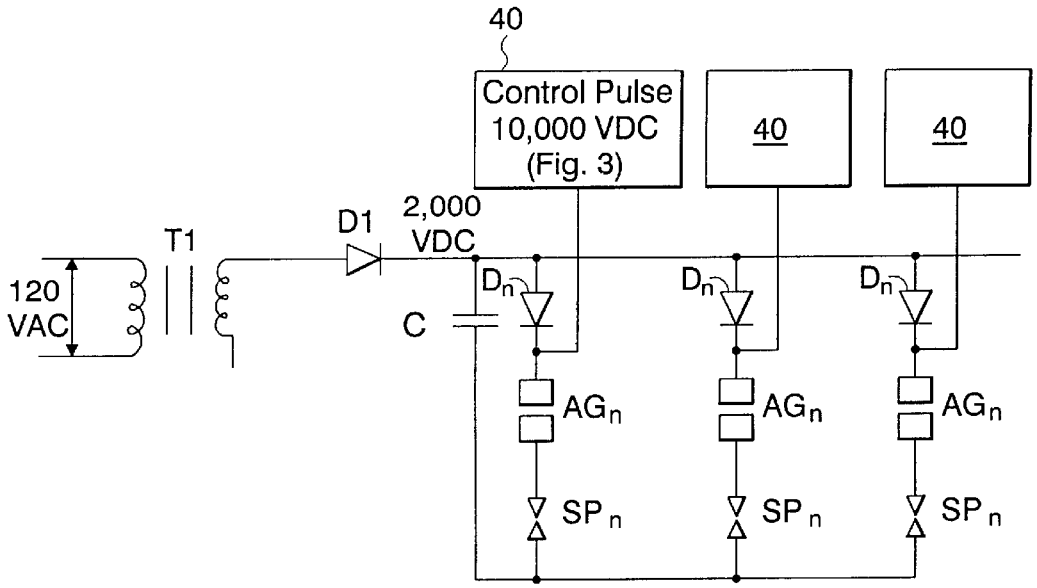
FIG. 4 illustrates an embodiment of a multiple igniter circuit wherein one power source T1, similar to FIG. 1, operates multiple igniter circuits coupled in parallel.

FIG. 4 illustrates an embodiment of a multiple igniter circuit wherein one 2000 volt power source T1, connected similar to FIG. 1, operates n multiple igniter circuits coupled in parallel, each comprising a diode Dn, having a pulsed 10,000 VDC at its cathode, coupled in series with an air gap AGn and a spark plug SPn. This embodiment could be used in an installation having multiple burners.

When the charge voltage V1 across the capacitor C reaches a predetermined threshold voltage, ~=2,000 VDC, a trigger signal T closes an SSR1, connected similar to FIG. 3, to energize T2 which produces V2=10,000 VDC, in a manner similar to FIG. 1 although not shown in detail in FIG. 4. Diode Dn prevents the voltage V2 from producing a current flow into capacitor C. The voltage V2 is sufficient to produce a spark simultaneously over the two gaps AG and SP, which discharges the capacitor C through diode Dn. The arc at the arc discharge terminals of the sparkplug SPn is positioned in a fuel stream such that the arc ignites difficult to ignite fuels because of its intense current and rapid repetition rate.

Auxilliary circuits can be added to the basic igniter circuits as described above for purposes of safety or component durability. The logic circuit for generating the trigger signal T might incorporate safeguards. For instance, the circuit might shut down if a current flow through the spark plug SP is not detected, which can be indicative of a faulty field hook up. Or a silicon controlled rectifier SCR or similar device can be controlled by the voltage on the capacitor C, to reduce the input power to the power source T1 to prevent an overcharge of the capacitor C. The auxiliary circuits would only serve to enhance the operability of the basic igniter circuit as described above, and would not significantly alter the main function and operation of the basic igniter circuit.

While several embodiments and variations of the present invention for an igniter circuit with an air gap are described in detail herein, it should be apparent that the disclosure and teachings of the present invention will suggest many alternative designs to those skilled in the art.

I claim:

1. An igniter circuit for a fuel ignition system designed to preclude fuel contamination from interfering with conduction of an ignition arc across an established current path between electrodes of a spark plug in the ignition system comprising:

an air gap and a spark plug connected in series, wherein the spark plug produces an ignition arc in a fuel to be ignited;

a first high voltage power supply for developing a first direct current voltage across a capacitor, which is supplied as a voltage across the air gap and the spark plug;

a second high voltage power supply, operating in a pulsed mode, for supplying a second pulsed voltage across the air gap and the spark plug, wherein the second pulsed voltage is substantially higher than the first direct current voltage, and the second pulsed voltage is sufficient to initiate an ignition arc, and the first direct current voltage is sufficient to sustain the ignition arc, and a diode, positioned between the second pulsed voltage and the capacitor of the first high voltage power supply, to isolate the capacitor from the second pulsed voltage.

2. The igniter current of claim 1, wherein:

the first high voltage power supply comprises a first voltage step up transformer having a diode coupled in series therewith to provide the first direct current voltage; and the second high voltage power supply comprises a second voltage step up transformer having a pulse circuit in series with a primary winding of the second transformer to pulse operation of the second transformer.

3. The igniter current of claim 1, wherein:

the first high voltage power supply comprises a first DC to DC step-up power converter circuit for producing the first direct current voltage; and the second high voltage power supply comprises a second DC to DC step-up power converter circuit for producing the second voltage, and a pulse circuit coupled to the second high voltage power supply, to pulse the operation of the second high voltage power supply.

4. The igniter circuit of claim 2, wherein the first transformer receives a typical input of 120 VAC, and generates an output voltage V1AC of approximately 2,000 volts, is naturally current limiting, and is always on when the igniter circuit unit is energized, a diode rectifies the 2000 V1AC to 2,000 V1DC which charges the capacitor, and the voltage across the capacitor is available through a diode as an input to the air gap.

5. The igniter circuit of claim 4, wherein the second transformer receives a typical input of 120 VAC, and generates an output voltage V2AC of approximately 5,000 to 10,000 or higher volts, is only activated on when a trigger signal T is present to a solid state relay coupled in series with the input to the second transformer.

6. The igniter circuit of claim 5, wherein the solid state relay turns on a 100 watt circuit at a frequency between 1 and 20 HZ, and is initiated by the trigger signal T.

7. The igniter circuit of claim 1, wherein the second power supply operates in a pulsed mode under control of a trigger signal T, and when the voltage across the capacitor reaches a predetermined voltage, the trigger signal T is a short duration pulse having a width on the order of 5 to 20 milliseconds, and is then turned off until the voltage across the capacitor again reaches the predetermined voltage.

8. The igniter circuit of claim 1, wherein the second power supply operates in a pulsed mode under control of a trigger signal T, and the trigger signal T is turned off when the voltage across the capacitor drops to a predetermined low voltage.

9. The igniter circuit of claim 1, wherein the second power supply operates in a pulsed mode under control of a trigger signal T, and the trigger signal T is pulsed on at a fixed rate for a finite duration, such as 4 pulses per second, with each pulse having a pulse width of approximately 20 milliseconds.

10. The igniter circuit of claim 1, wherein the air gap is formed as a simple air gap of about ⅛" opening between two opposed electrodes.

11. The igniter circuit of claim 10, wherein the breakdown voltage is variable between 4000 and 8000 volts by varying the width of the air gap.

* * * * *